US011882939B2

(12) United States Patent
Gansow et al.

(10) Patent No.: US 11,882,939 B2
(45) Date of Patent: Jan. 30, 2024

(54) MODULAR FURNITURE SYSTEM

(71) Applicant: VETSAK GMBH, Düsseldorf (DE)

(72) Inventors: Max Gansow, Neuss (DE); Marco Heimann, Neuss (DE); Hubertus Kläs, Munich (DE); Thomas Kirn, Grömbach (DE)

(73) Assignee: VETSAK GMBH, Dusseldorf (DE)

( * ) Notice: Subject to any disclaimer, the term of this patent is extended or adjusted under 35 U.S.C. 154(b) by 0 days.

(21) Appl. No.: 17/778,224

(22) PCT Filed: Nov. 20, 2020

(86) PCT No.: PCT/EP2020/082957
§ 371 (c)(1),
(2) Date: May 19, 2022

(87) PCT Pub. No.: WO2021/099601
PCT Pub. Date: May 27, 2021

(65) Prior Publication Data

US 2022/0408929 A1 Dec. 29, 2022

(30) Foreign Application Priority Data

Nov. 20, 2019 (DE) ..... 102019131332.5

(51) Int. Cl.
*A47C 4/02* (2006.01)
*A47C 13/00* (2006.01)
(Continued)

(52) U.S. Cl.
CPC ..... *A47C 4/028* (2013.01); *A47C 27/07* (2013.01); *A47C 31/02* (2013.01)

(58) Field of Classification Search
CPC ..... A47C 4/02; A47C 13/005
(Continued)

(56) References Cited

U.S. PATENT DOCUMENTS 3,811,728 A * 5/1974 Redemske ..... A47B 87/00 297/440.14 X
3,929,375 A * 12/1975 Gans ..... A47C 4/028 297/DIG. 6
(Continued)

FOREIGN PATENT DOCUMENTS

DE 2402525 A1 7/1975
DE 3634346 A * 4/1987 ..... A47C 13/005
(Continued)

OTHER PUBLICATIONS

International Search Report dated Feb. 1, 2021; International Application No. PCT/EP2020/082957.

*Primary Examiner* — Rodney B White
(74) *Attorney, Agent, or Firm* — Dinsmore & Shohl LLP

(57) ABSTRACT

A modular furniture system is for a variety of purposes and includes at least one furniture base module consisting of a backrest element, a seat base module, two upholstery elements and a plurality of foot elements. The backrest element and the seat base module are capable of being connected and fastened by the foot elements without the use of tools, so that the furniture base module is capable of being packed ready for assembly in a shipping carton with low dimensions, in particular with dimensions up to 120 cm×60 cm×60 cm, and with a reduced weight, in particular with a weight of less than 30 kg.

19 Claims, 15 Drawing Sheets

(51) Int. Cl.
*A47C 7/02* (2006.01)
*A47C 31/02* (2006.01)
*A47C 27/07* (2006.01)

(58) Field of Classification Search
USPC ..... 297/228.11, 440.1, 440.14
See application file for complete search history.

(56) References Cited

U.S. PATENT DOCUMENTS 3,944,281 A * 3/1976 Piretti ..... A47C 17/045 297/440.14
3,973,800 A * 8/1976 Kogan ..... A47C 13/005 297/135
4,077,666 A * 3/1978 Heumann ..... A47C 13/005 297/440.14 X
4,311,337 A * 1/1982 Brunn ..... A47C 1/124 297/440.22
4,621,381 A * 11/1986 Schramek ..... A47C 4/028 297/440.13
4,668,011 A * 5/1987 Fister, Jr. ..... A47C 31/11 297/226
4,893,958 A * 1/1990 Wieland ..... A47C 4/02 403/362
5,000,512 A * 3/1991 Laird ..... A47C 4/028 297/440.1 X
5,509,720 A * 4/1996 Croom ..... A63H 33/04 297/440.16
5,544,938 A * 8/1996 Saul ..... A47C 13/005 297/248
5,890,767 A * 4/1999 Chang ..... A47C 4/02 297/440.14 X
6,543,845 B2 * 4/2003 Seitz ..... A47C 17/02 248/200
7,044,557 B2 5/2006 Wieland
7,213,885 B2 * 5/2007 White, III ..... A47C 4/028 297/440.1 X
7,547,073 B2 6/2009 White, III et al.
7,806,474 B2 * 10/2010 Wahl ..... A47C 13/005 297/248
8,528,972 B2 * 9/2013 Johnsson ..... A47C 4/02 297/440.14 X
8,764,114 B1 * 7/2014 Frank ..... A47C 7/42 297/440.14 X
8,783,778 B2 * 7/2014 Nelson ..... A47C 13/005 297/440.1 X
9,004,585 B1 * 4/2015 Pidgornyy ..... A47C 13/005 5/52
9,273,709 B2 * 3/2016 Mehringer ..... F16B 12/10
9,277,826 B2 * 3/2016 Nelson ..... A47C 3/029
10,123,623 B2 * 11/2018 Nelson ..... F16B 12/00
10,159,355 B2 * 12/2018 Policicchio ..... A47C 20/021
10,182,659 B2 * 1/2019 Kuhl ..... A47C 17/04
10,327,557 B2 * 6/2019 Neil ..... A47C 7/02
10,433,648 B1 * 10/2019 Kuhl ..... A47C 17/86
10,905,245 B2 * 2/2021 Bangalore ..... F16B 12/125
11,178,973 B2 * 11/2021 Nelson ..... A47C 19/005
2005/0046243 A1 * 3/2005 Cimino ..... A47C 7/42 297/124
2008/0252130 A1 10/2008 Wieland et al.
2009/0045666 A1 * 2/2009 Westendorf ..... A47C 13/005 297/440.1
2010/0244536 A1 * 9/2010 Chen ..... A47C 4/02 297/440.15
2010/0244537 A1 * 9/2010 Chen ..... A47C 4/02 297/440.15 X
2011/0233976 A1 * 9/2011 Hanson ..... A47C 4/028 297/440.14
2011/0298340 A1 12/2011 Nelson et al.
2012/0256464 A1 * 10/2012 Chang ..... A47C 13/005 297/440.16
2016/0022054 A1 * 1/2016 Griffin ..... A47C 31/11 297/228.11
2016/0128486 A1 * 5/2016 Chia ..... A47C 11/00 297/440.14
2017/0354262 A1 * 12/2017 Neil ..... A47C 7/02
2020/0268160 A1 * 8/2020 Kuhl ..... A47C 15/002
2021/0186220 A1 * 6/2021 Bangalore ..... F16B 12/125
2022/0211183 A1 * 7/2022 Bangalore ..... A47C 13/005

FOREIGN PATENT DOCUMENTS

DE 8607261 U1 7/1987
DE 202004008408 U1 * 9/2004 ..... A47C 1/124
EP 2145567 A1 * 1/2010 ..... A47C 13/005
EP 2213204 A1 * 8/2010 ..... A47C 13/005
EP 2213205 A1 * 8/2010 ..... A47C 13/005
EP 3213658 A1 9/2017
EP 3292793 A1 3/2018
FR 2933855 A1 * 1/2010 ..... A47C 13/005
WO 2006135509 A2 12/2006
WO 2017222580 A1 12/2017

* cited by examiner

MODULAR FURNITURE SYSTEM

CROSS-REFERENCE TO RELATED APPLICATIONS

This application is the U.S. National Stage of PCT/EP2020/082957 filed on Nov. 20, 2020, which claims priority to German Patent Application 102019131332.5 filed on Nov. 20, 2019, the entire content of both are incorporated herein by reference in their entirety.

FIELD OF THE INVENTION

The present invention relates to a modular furniture system for a variety of purposes comprising at least one furniture base module consisting of a backrest element, a seat base module, two upholstery elements and a plurality of foot elements.

BACKGROUND OF THE INVENTION

Modular furniture systems that consist of a plurality of furniture units that are capable of being releasably connected and fastened to one another are known to the prior art.

A generic, modular seating furniture is, for example, described in EP 3 292 793 A1. The seating furniture consists of individual seating furniture elements. The seating furniture elements can be connected to one another by connecting units, while a plurality of connecting recesses are provided in a grid-like manner on the underside of each seating furniture element. Each connecting unit comprises a foot element and connecting studs, wherein the foot element is designed as the foot of the seating furniture, and the connecting studs are arranged opposite the foot element corresponding to the connecting recesses of the seating furniture element. The seating furniture elements with the connecting units are thus capable of being connected to one another and released from one another from underneath the seating furniture element, without the use of tools and in a variety of ways as desired. A seat part of the modular seating furniture presented in EP 3 292 793 A1 does not consist of two basic elements that are capable of being connected to one another, but the seat part is instead designed as one piece, which means that the seating furniture cannot be shipped economically in one package.

DE 24 02 525 A1 discloses a connecting fitting for connecting a plurality of seating furniture items into one seating group. The fitting consists of a clamping arm and a bolt plate. The clamping arm is arranged in the plane of the underside of the furniture, and has spring-loaded, expandable longitudinal latch slots. The bolt plate can be fastened to an underside of a further furniture element using two fastening holes. An engagement bolt is formed in the centre of the bolt plate. By latching the engagement bolt of the bolt plate between the longitudinal latch slots, the furniture elements may be firmly fastened to one another from the underside. The clamping arm can be swivel-mounted by means of a hole. The seat group does not have a multi-part seat part. A large volume is therefore needed for transport, and transport costs are high.

A component set with which furniture elements are capable of being releasably connected to one another on the underside by feet is illustrated in DE 86 07 261 U1. The component set comprises a pin-shaped connector and two sliders. Each slider is attached with a fastening pin to a central axis of a frame or foot of the furniture element. The connector may be brought into various positions in the slider and fastened by grooves at both ends. DE 86 07 261 U1 shows a possibility for connecting two seating furniture items to one another. A seat part of the seating furniture is designed in one piece, and can only be shipped with a large transport volume. The transport costs are therefore high.

WO 2017/222580 A1 furthermore discloses a modular furniture system consisting of a plurality of furniture units that can be connected by means of connecting elements. Transport should thereby be made easier, and seating furniture that can be used flexibly is provided. Since the external dimensions of rectangular and inclined furniture units are matched to one another, different seating groups can easily be assembled. The coupling of the individual furniture units is supported by foot elements that are arranged on the underside of the furniture unit. The seating furniture that is to be connected is designed with a one-piece seat part, so that high transport expenditure is entailed by transport.

WO 2006/135509 A2 furthermore illustrates a modular furniture unit with which seating groups put together in different ways can be created. The transport can thereby be made easier. The individual elements can be fixed to one another by means of a foot connecting element. The seating group does not comprise a seat part consisting of multiple parts. The seating furniture can thus not be shipped economically in one package.

It is disadvantageous to the prior art that a modular furniture system as referred to above requires a relatively large transport volume when being transported, so that the transport is complex and expensive.

A further disadvantage of the known modular furniture system is that the modularity can only be exploited within narrow limits.

On the basis of the above prior art, it is the object of the invention to provide a better transport possibility, and thereby reduce costs significantly.

It is, furthermore, an object of the invention to create a freely-combinable modularity, so that very different furniture landscapes can be realized for different purposes from identical furniture base modules.

This object is achieved by a modular furniture system with the features as disclosed herein. Advantageous developments of the invention are also disclosed.

SUMMARY OF THE INVENTION

The invention relates to a modular furniture system for a variety of purposes comprising at least one furniture base module consisting of a backrest element, a seat base module, two upholstery elements and a plurality of foot elements.

It is proposed according to the invention that the backrest element and the seat base module are capable of being interconnected and fastened by the foot elements without the use of tools, so that the furniture base module can be packed ready for assembly in a shipping carton with low dimensions, in particular with dimensions up to 120 cm×60 cm×60 cm, and with a reduced weight, in particular with a weight of less than 30 kg.

A modular furniture system consisting of at least one furniture base module that is capable of being dismantled into small parts and therefore effectively transported is thus proposed. The feature, according to which the furniture base module consists of a backrest element, a seat base module, two upholstery elements and a plurality of foot elements, wherein these are capable of being connected to one another through the foot elements without using tools, enables a much smaller package volume in comparison with a conventional modular furniture system, so that the furniture base module fits into a small shipping carton with a maximum size of 60 cm×60 cm×120 cm. In particular, a combined length and girth of up to 360 cm (where the combined length and girth can be found from (height+width)×2+length) can be maintained. In addition, a total weight of less than 30 kg can be maintained. With a package of this size and weight, the package can be shipped by single package delivery service, wherein heavy-load shipping is not necessary and shipping costs can be saved. The seat base module and/or the backrest element may for this purpose consist of a foamed material, such as polypropylene or polystyrene, so that the furniture base module may have a low total weight in comparison with the volume. Assembly and disassembly of the furniture system and all of the individual parts such as the cover, springing, and add-on parts is possible without tools at any time.

This has the advantageous result that the modular furniture system can be shipped economically in one shipping carton by a shipping service provider such as DHL, HERMES, UPS or the like, and is capable of being transported easily by one person. The shipping costs for such shipping cartons typically amount to around 8 euros, whereas typical heavy-load transport costs for complete furniture elements amount to 120 euros or more. The transport costs and the logistical outlay of such a shipment are thus significantly reduced.

It is furthermore advantageous that the modular furniture system is capable of being assembled from at least one furniture base module. The modular furniture system can thus be given different appearances, as desired, by assembling the furniture base modules in different ways, so that the modular furniture system can be used, as required, in a living area, lounge area, a semi-public area, or an outdoor area.

In one advantageous development of the modular furniture system, the seat base module can consist of at least two seat base elements, wherein the seat base elements are preferably substantially identically designed, and are capable of being joined to one another to form a seat base module by means of at least one connecting means, preferably of complementary function, preferably without tools. Fastening holes can be provided for this purpose in an edge region of one of the seat base elements, through which screws or rivets can be passed to fasten the seat base element to the other seat base element. If fastening holes are not provided, the edge regions of the seat base elements can each be provided with at least one fastening magnet. The fastening of the seat base elements can, furthermore, be achieved through gluing. It is furthermore possible to achieve a connection between the seat base elements using at least one latching connection.

In a further advantageous development, the seat base element may be capable of being plugged together and joined to form the seat base module in a functionally complementary manner by means of at least one pair, preferably two pairs, in particular several pairs of dovetail guides, wherein the dovetail guides are designed as the connecting means. The dovetail guides of the seat base element may have a first connecting profile. The other seat base element to be joined may be provided with the dovetail guides that have a second connecting profile that is designed to have a shape that is complementary to the first connecting profile. This can have the advantageous result that the seat base elements are capable of being assembled and joined easily. Fastening without tools can be enabled in this way.

In a further advantageous development, the at least one pair of dovetail guides may be provided in a wall region and/or a base region of the seat base element. The dovetail guides may advantageously be formed as one piece with the seat base element, so that it is possible for no further fastening means to be required between the seat base element and the dovetail guides. The dovetail guides may, alternatively, be attached to the seat base element by means of at least one fastening means. The dovetail guides can thus be replaced when worn out.

In this development, the seat base element may be provided with an additional means of joining in an edge region. In this way it can be ensured that the seat base elements are securely and firmly joined to one another.

On the basis of the previous embodiment, in one further advantageous development, the at least two pairs, in particular the multiple pairs, of the dovetail guides may be formed in the wall region and/or in the base region of the seat base element. In other words, the seat base element can be fitted with dovetail guides that are formed both in the wall region and in the base region. This has the advantageous effect that no additional space has to be provided at an outer surface of the seat base element for an arrangement of the dovetail guides.

In a further advantageous development, at least one pot-shaped foot element may be designed and pre-moulded in the dovetail joints to support the furniture base module on the base side. Each dovetail joint may consist of a pair of two dovetail guides. Advantageously, at least one pot-shaped foot element may be formed as one piece at a part of the dovetail joint. In this way it is possible that in addition to the foot elements by which the backrest element and the seat base element are capable of being joined and fastened without tools, a further possibility can be offered for supporting the furniture base module, in particular for supporting the modular furniture system, and to prevent unintentional release of the connection.

In a further advantageous development, at least one, in particular a plurality, of recesses to accommodate the foot element may be provided on a base side of the seat base module and/or on a base side of the backrest element, wherein the recesses are preferably formed in the edge region of the seat base module and/or of the backrest element. The recesses can be designed with a pot-like shape. The foot elements can be inserted, preferably without tools, into the pot-shaped recesses that are formed on the base side of the seat base module and/or of the backrest element. As a result, the seat base module can be connected to the backrest element, or the seat base modules can be connected to one another as desired. Highly varied furniture landscapes can thus be realized for different purposes.

In a further advantageous development, foot elements that are arranged adjacent to one another may be capable of being connected to one another by means of at least one bracket element. The bracket element can advantageously have a U-shaped design. Advantageously, furthermore, the U-shaped bracket element can be of insertable design, wherein the U-shaped bracket element may comprise two insertion regions at the ends for insertion into the foot elements of adjacent furniture base modules, and a connecting region for connecting these foot elements. A connection between the two foot elements may hereby be provided by means of the U-shaped bracket element. The bracket element here is preferably made in one piece. The bracket element may, furthermore, consist of metal, wood or of a plastic material.

On the basis of the previous embodiment, the foot element may consist of at least two shell parts that are capable of being plugged together and latched, wherein at least one shell part comprises an embedding receptacle for an end region of the bracket element. More than one embedding receptacle may advantageously be provided, so that end regions of two or a plurality of bracket elements are capable of being accommodated in order to enable cross-corner connections or also crossover connections by means of the bracket elements. The shell parts may preferably consist of a plastic material. The end region of the bracket element may be inserted into the embedding receptacle. Each shell part may, furthermore, comprise push-in and latching elements for connecting to a second shell part preferably having a complementary shape, in particular of identical design, so that the foot element can be formed by pushing and latching the two shell parts together without the use of tools. The push-in elements serve for mechanically fixing the shell parts to one another to form the foot element, wherein, by means of a latching notch, the latching elements provide an additional safeguard when pushed together. It is advantageous that guide ribs are provided in the longitudinal direction of the foot element on an outer surface of an push-in regions of the foot element or of the shell part. Because, when the foot element is inserted into the recesses of the base side of the seat base module or of the backrest element, the guide ribs press into the soft, foamed material of the base side, a form-fitting resistance to rotation, and a better push-in effect, can be ensured.

In a further advantageous development, at least one recess may be formed on an upper side of the seat base element along the wall region to accommodate spring elements for the upholstery element arranged on the seat base module. The recess can be trough-shaped, while a plurality of spring elements may be arranged and fastened on the circumferential side of the recess at the upper side of the seat base module. The upholstery element may be arranged on the spring elements, or the spring elements may be integrated into or inserted into the upholstery element. The recess permits the definition of a spring region into which the spring elements can plunge in order to develop a spring characteristic.

On the basis of the preceding embodiment, at least one spring element may be designed as a spring strip, wherein the spring strip comprises a leaf spring envelope with at least one wing area and at least one rod-shaped core arranged in the leaf spring envelope with a spring characteristic that depends on the material. The different spring characteristics can be achieved in that the core consists of different materials such as, for example, steel, aluminium, wood or a plastic material. The leaf spring envelope with the wing areas may advantageously consist of a different material, in particular of a different plastic material. The at least one wing area can have a supporting effect in the radial direction with respect to the core, and the core can provide a supporting effect in the longitudinal direction, so that longitudinal and transverse springing are capable of being separately and individually modified, for example, by changing the material. The spring strips may, furthermore, be fastened at least temporarily to the seat base module by screws or dowels.

On the basis of the preceding embodiment, the core and/or the leaf spring envelope with the at least one wing area may be designed to be exchangeable with different materials. It is advantageous that the core and/or the leaf spring envelope are designed to be exchangeable. It is therefore possible for the spring characteristics of the furniture base module or of the modular furniture system to be changeable according to need and to be individually adjustable.

In a further advantageous development, at least one seat base element of the seat base module may comprise a framework structure, preferably with a spring characteristic, wherein the framework structure is preferably formed on the base side of the seat base element. It is advantageous that the framework structure can bring about a spring characteristic. Additional springing for the seat base module can be provided in this way. The framework structure furthermore advantageously enables improved ventilation and reduces the weight, while material can be saved.

In a further advantageous development, the upholstery element may be designed as a spring mat that is capable of being fastened to the seat base module and/or to the backrest element. The spring mat is capable of being placed on a seat frame of the seat base module and/or a backrest frame of the backrest element, wherein multiple spring elements may be inserted into the spring mat. It is advantageous that the spring mat is designed as a foam cushion, so that the spring elements, or the spring strips therein, are capable of being rolled together and can be placed as one piece on the seat frame and/or the backrest frame. The spring mat may be fastened with a fastening means to the seat base module, although this is not essential.

On the basis of the preceding embodiment, the spring elements or the spring strips may be inserted into the spring mat. A large number of depressions may here be preformed in the spring mat for the arrangement of the spring elements or the spring strips, wherein at least one spring element or one spring strip may be inserted into each depression. Alternatively, one or a plurality, in particular parallel, insertion channels may be provided in the spring mat, into which the spring elements can be pushed. These spring elements or spring strips may be fixed in the spring mat without fastening means. This advantageously has the effect that additional springing can be integrated into the spring mat, so that the upholstery element can be provided with what is known as double-springing. Better damping can be achieved in this way.

In a further advantageous development, the upholstery element is designed in the form of a cushion cover with a lower opening, so that the upholstery element is capable of being stretched on the seat base module and/or on the backrest element without using tools. The cushion cover may be provided with an elastic band in an edge region along the lower opening, so that the upholstery element can be fastened to the seat base module and/or to the backrest element by means of the elastic band without using tools. The upholstery element can be taken off, washed or exchanged, allowing the furniture base module a longer service life than the upholstery element. The colour and pattern printing of the upholstery element can, furthermore, be matched to a user's preferences, and offered separately as a replacement set.

On the basis of the previous embodiment, along the lower opening of the upholstery element or the cushion cover, an at least partially surrounding hook and loop tape may be provided on side walls of the opening for fixing the upholstery element or the cushion cover to the basic seat module and/or to the backrest element, wherein a complementary hook and loop tape is provided running around a peripheral surface on the base side of the seat base module and/or of the backrest element. This complementary hook and loop tape may be provided in the manner of a hook and loop fastening that depends on the hook and loop tape provided on the side walls of the opening of the upholstery element.

The upholstery element may be pulled onto the seat base module and/or onto the backrest element and fastened by means of the hook and loop tape before the seat base module and the backrest element are brought together. Alternatively, the upholstery element may be pulled on after assembly of the furniture base module, and fixed to the seat base module and/or the backrest element by means of the hook and loop tape. It is advantageous that a hook and loop connection of the upholstery element to the seat base module or to the backrest element by means of the hook and loop tape provided on the floor-side circumferential surface can provide a U-shaped enclosure of floor-side edges of the seat base module or of the backrest element may be under tension, so that overstretching the hook and loop connection is prevented, and a lasting, reliable fastening of the upholstery element to the seat base model and/or the backrest element can be ensured.

In a further advantageous development, an insertion slot or insertion groove may be formed on at least one edge of the base side of the seat base module and/or on the base side of the backrest element for a push-in fastening of the upholstery element preferably surrounding it at least in sections. The upholstery element may be provided, at least in sections, with an end strip in the push-in region to improve a force-locked push-in connection of the upholstery element to the seat base module or to the backrest element.

On the basis of the preceding embodiment, at least one hem region of the upholstery element may be provided with an end strip for closing off the opening of the upholstery element, wherein the end strip is capable of being inserted into the insertion slot so that the upholstery element may be fastened to the seat base module and/or to the backrest element. The upholstery element may either be pulled onto the seat base module and/or onto the backrest element before assembly of the seat base module and the backrest element, or may be pulled on after assembly of the furniture base module. The upholstery element may subsequently be fastened by means of the end strip. The end strip may be formed as a plastic strip that may be inserted into the insertion slot and fixed, so that the upholstery element can be prevented from being pulled down off the furniture base module. In a fastening position, the plastic strip may be aligned vertically upwards, so that the hem region of the opening of the upholstery element can surround in a U-shaped manner the lower edge of the seat base module or of the backrest element. Through a push-in connection of the upholstery element to the seat base module or to the backrest element by means of the inserted end strip, the U-shaped enclosure of floor-side edges of the seat base module or of the backrest element may be under tension, so that the end strip can be prevented from slipping down, and a reliable fixing of the upholstery element to the seat base module or to the backrest element can be ensured.

In a further advantageous development, the seat base module and/or the backrest element may be trapezoidal in shape, wherein the backrest element may be fastened by the foot elements to a long side or a short side of the seat base module. It is advantageous that the trapezoidal seat base modules and/or the trapezoidal backrest elements are connected to the seat base modules and/or the backrest elements that have a different shape. In this way, the modular furniture system can be curved in any desired way, with seat regions having convex or concave forms.

BRIEF DESCRIPTION OF THE DRAWINGS

Further advantages emerge from the figures and the associated descriptions of the drawings. Embodiments of the invention are illustrated in the figures. The figures and the description contain numerous features in combinations. The expert will expediently also consider the features individually and merge them to form useful further combinations. In the figures.

DETAILED DESCRIPTION OF THE INVENTION

Identical or similar components are given the same reference signs in the figures.

Figure 1A:
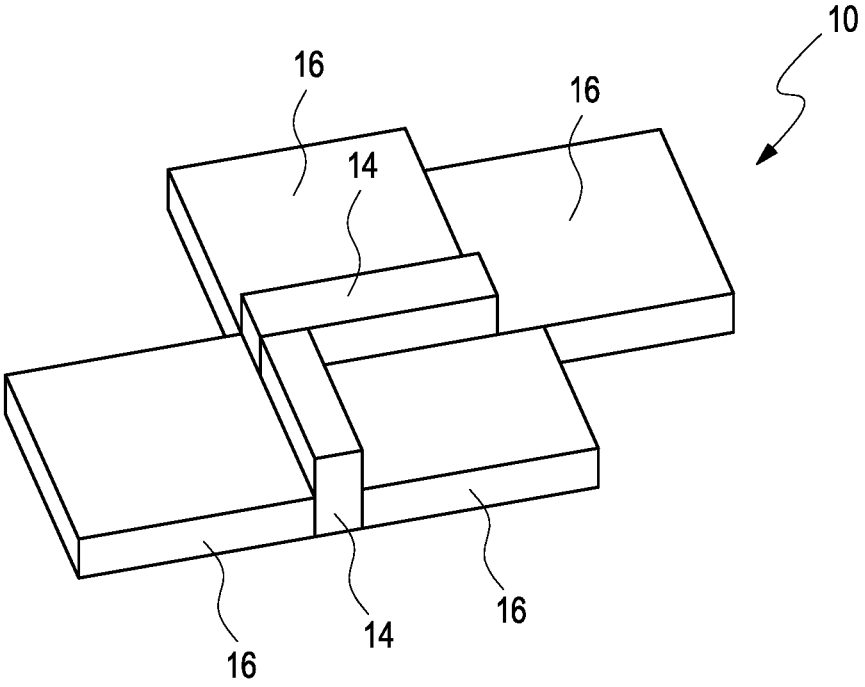
FIG. 1*a* shows a perspective illustration of a modular furniture system according to a first embodiment.
Figure 1B:
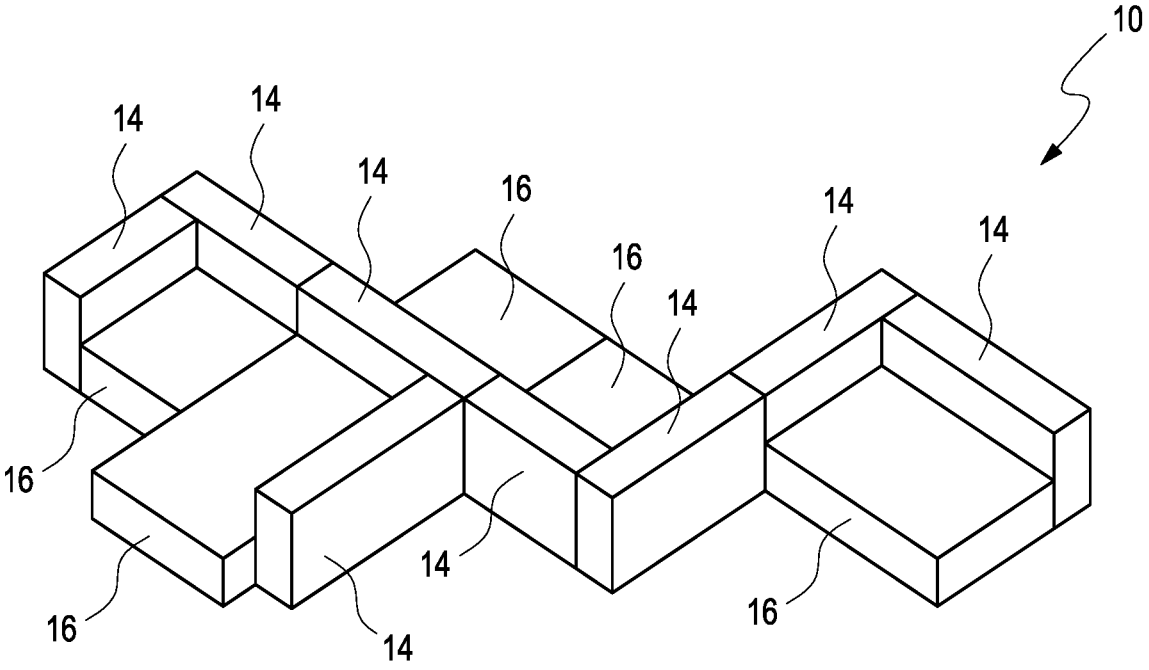
FIG. 1*b* shows a perspective illustration of a modular furniture system according to a further embodiment.

FIGS. 1*a* and 1*b* show perspective views of different embodiments of a modular furniture system 10, wherein seat base modules 16 and backrest elements 14 are connected to one another with different mutual alignments.

Figure 2A:
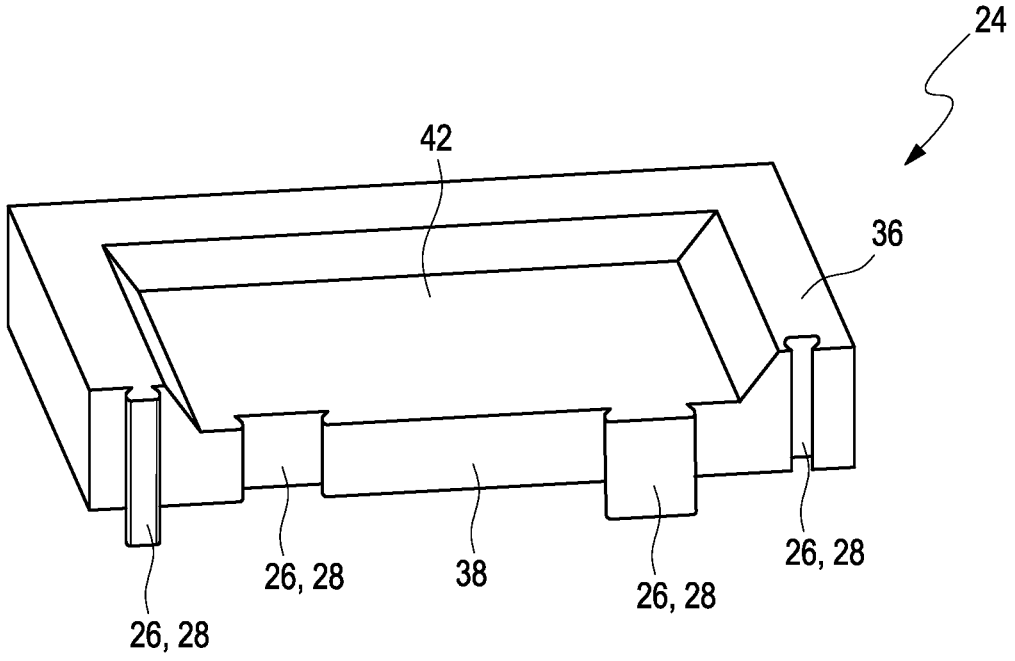
FIG. 2*a* shows a perspective illustration of a first embodiment of a seat base element.
Figure 2B:
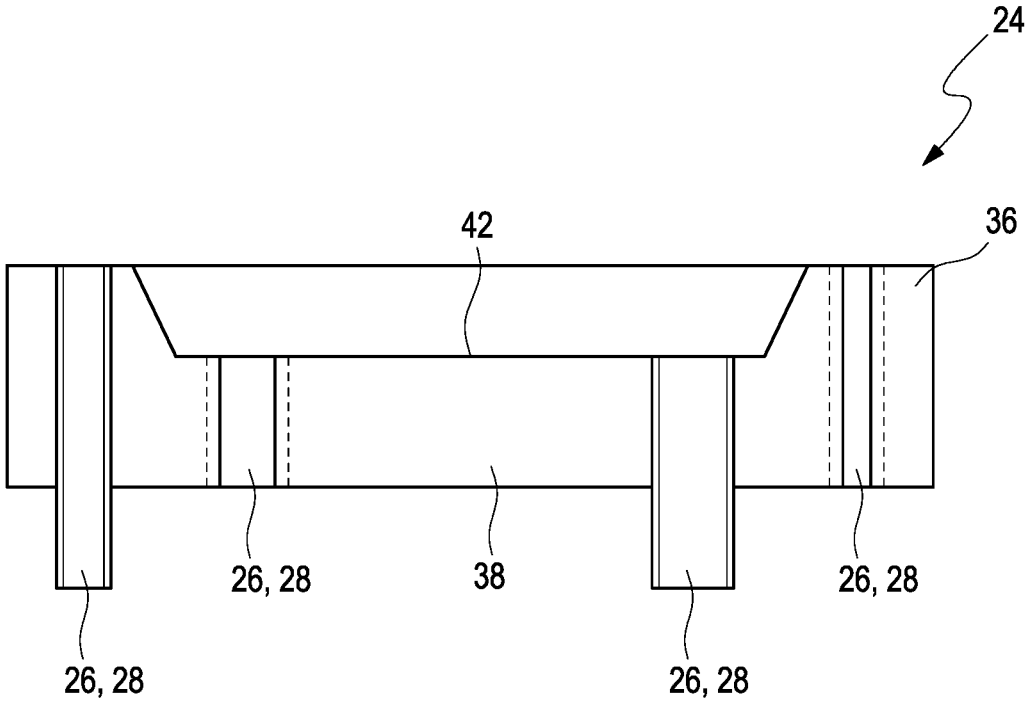
FIG. 2*b* shows a frontal view of a detail of the seat base element illustrated in FIG. 2*a;*

A seat base element 24 is illustrated in FIGS. 2*a* and 2*b* which is capable of being pushed together and connected to another identically designed seat base element 24 in a complementary manner by means of two pairs of dovetail guides 28 to form a seat base module 16, wherein the dovetail guides 28 are designed as a connecting means 26. The two pairs of dovetail guides 28 are each provided at a wall region 36 and a base region 38 of the seat base element 24.

Figure 3:
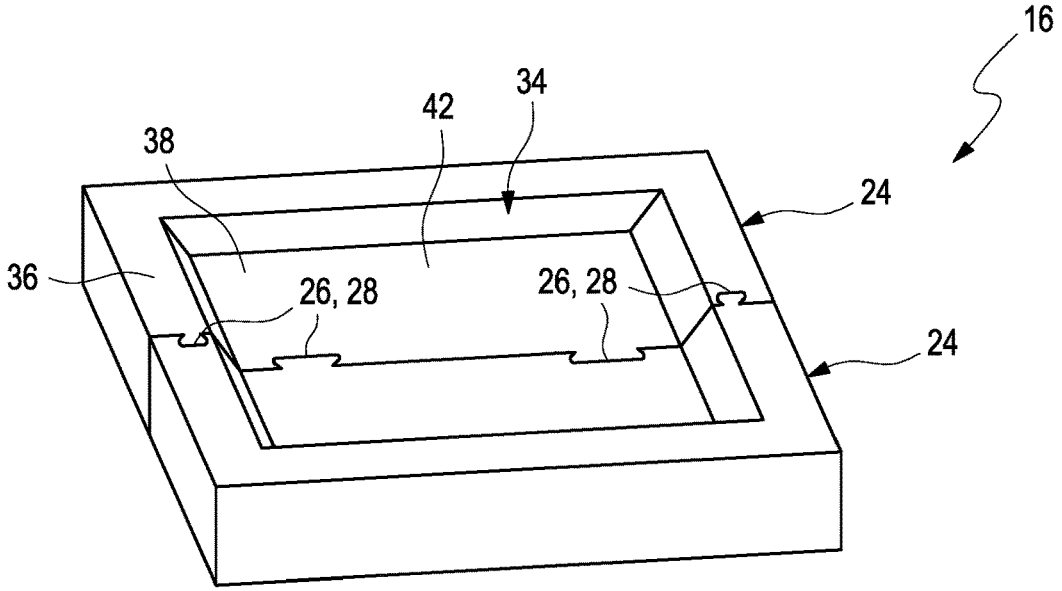
FIG. 3 shows a perspective illustration of a first embodiment of a seat base module.

A seat base module 16 is shown in FIG. 3. The seat base module 16 consists of two seat base elements 24 illustrated in FIG. 2*a*, wherein the seat base elements 24 are pushed together by means of two pairs of the dovetail guides 28. The dovetail guides 28 are designed with complementary functions, and are provided as connecting means 26. The two pairs of dovetail guides 28 are each fitted in the wall region 36 and in the base region 38 of the seat base element 24. A recess 42 is formed on an upper side 34 of the seat base module 16 along a wall region 36 to accommodate spring elements 44 illustrated in FIG. 4*a* for an upholstery element 18 arranged on the seat base module 16.

Figure 4A:
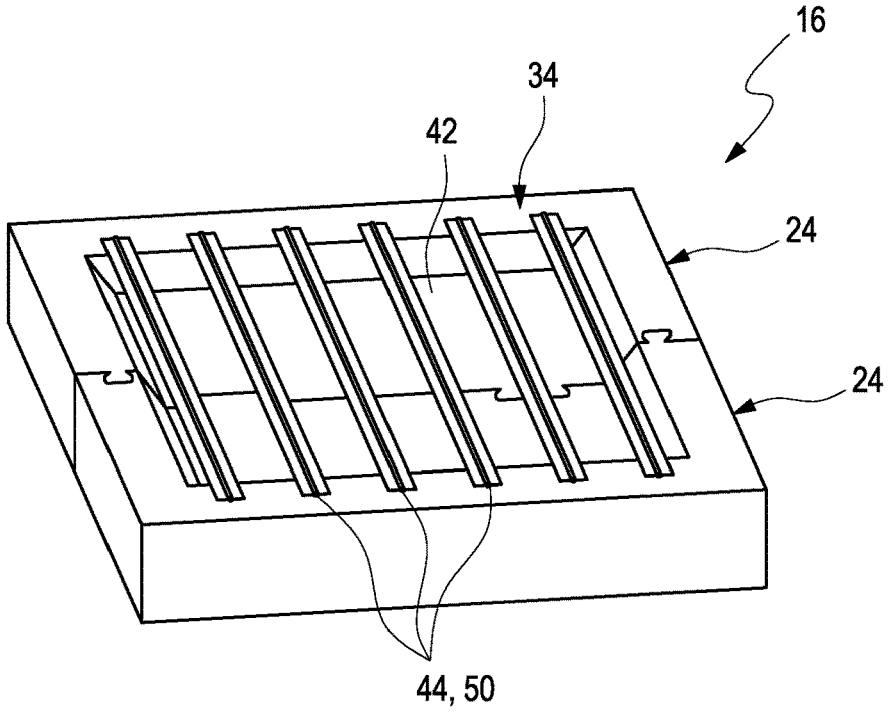
FIG. 4*a* shows a perspective illustration of the seat base element illustrated in FIG. 3 with spring elements.
Figure 4B:
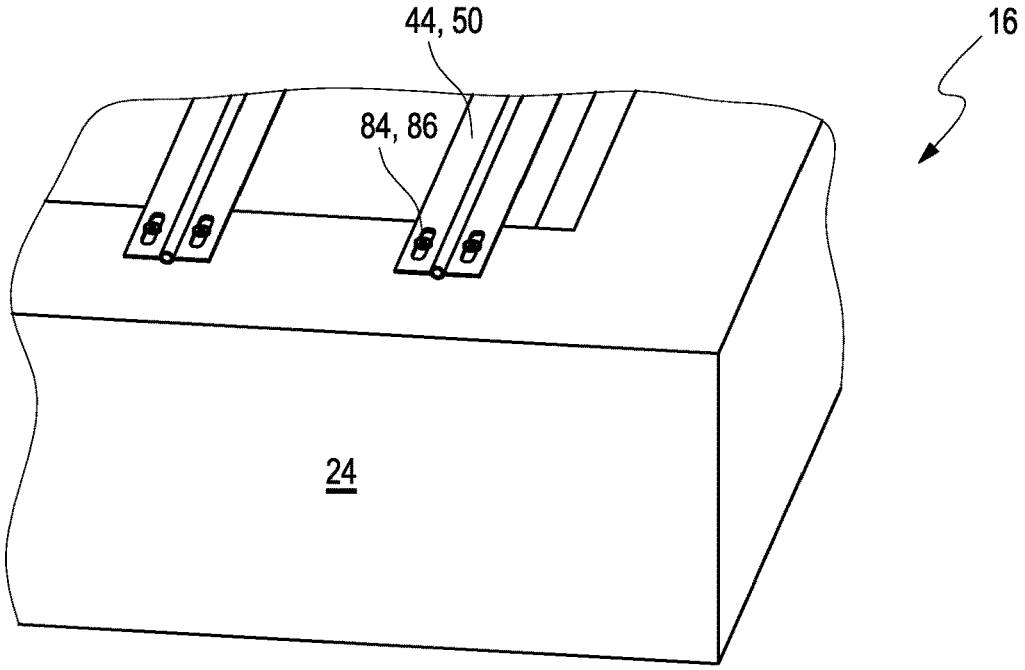
FIG. 4*b* shows a perspective illustration of a detail of the seat base element illustrated in FIG. 4*a* with spring elements.

In FIGS. 4*a* and 4*b* the seat base module 16 illustrated in FIG. 3 with the spring elements 44 consisting of two seat base elements 24 pushed together is shown, wherein the seat base module 16 consists of the two seat base elements 24, and the spring elements 44 are designed as spring strips 50. The spring elements 44 are located in the recess 42, and each spring element 44 is fastened to the seat base module 16 by means of at least one screw 86 provided as fastening means 84.

Figure 5:
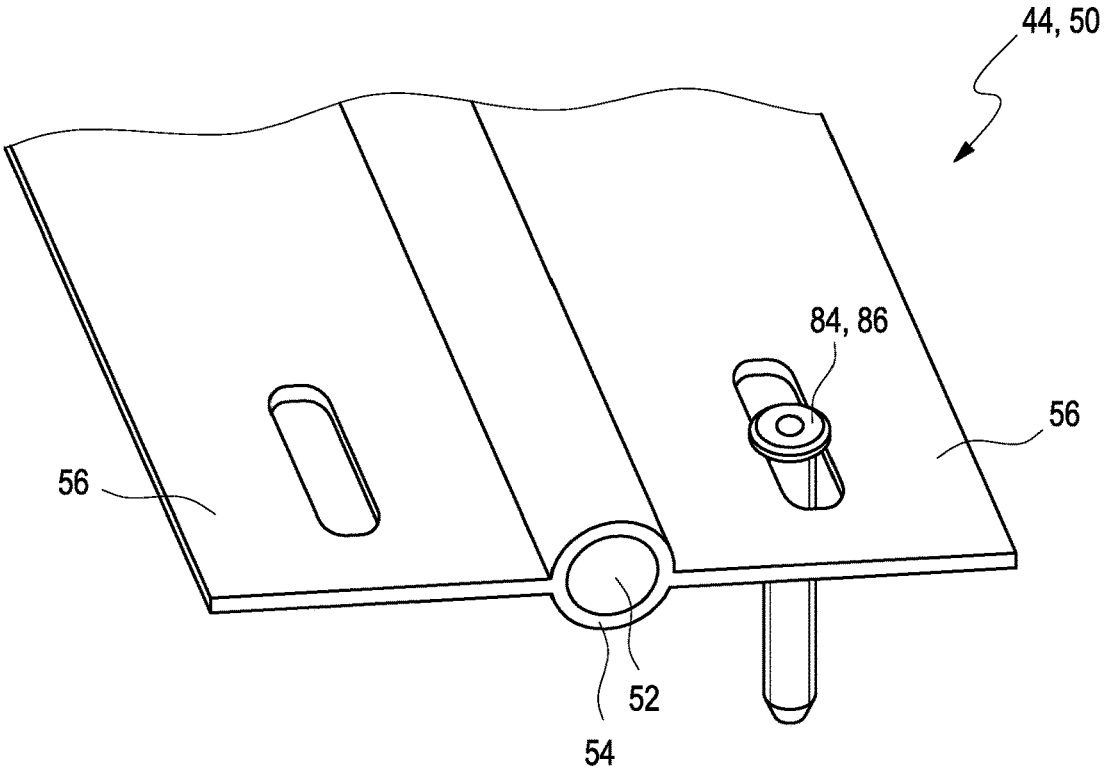
FIG. 5 shows a perspective illustration of the spring element illustrated in FIG. 4.

FIG. 5 represents the spring element 44 shown in FIGS. 4*a* and 4*b* in detail, wherein the spring element 44 is designed as a spring strip 50. The spring strip 50 comprises a leaf spring envelope 54 with both wing areas 56 and a rod-shaped core 52 that is arranged in the leaf spring envelope 54. The core 52 further has a material-dependent spring characteristic. The spring strip 50 may be fixed to the seat base module 16 by means of a screw 86 provided as a fastening means 84, which can may also be designed as a push-in dowel.

Figure 6A:
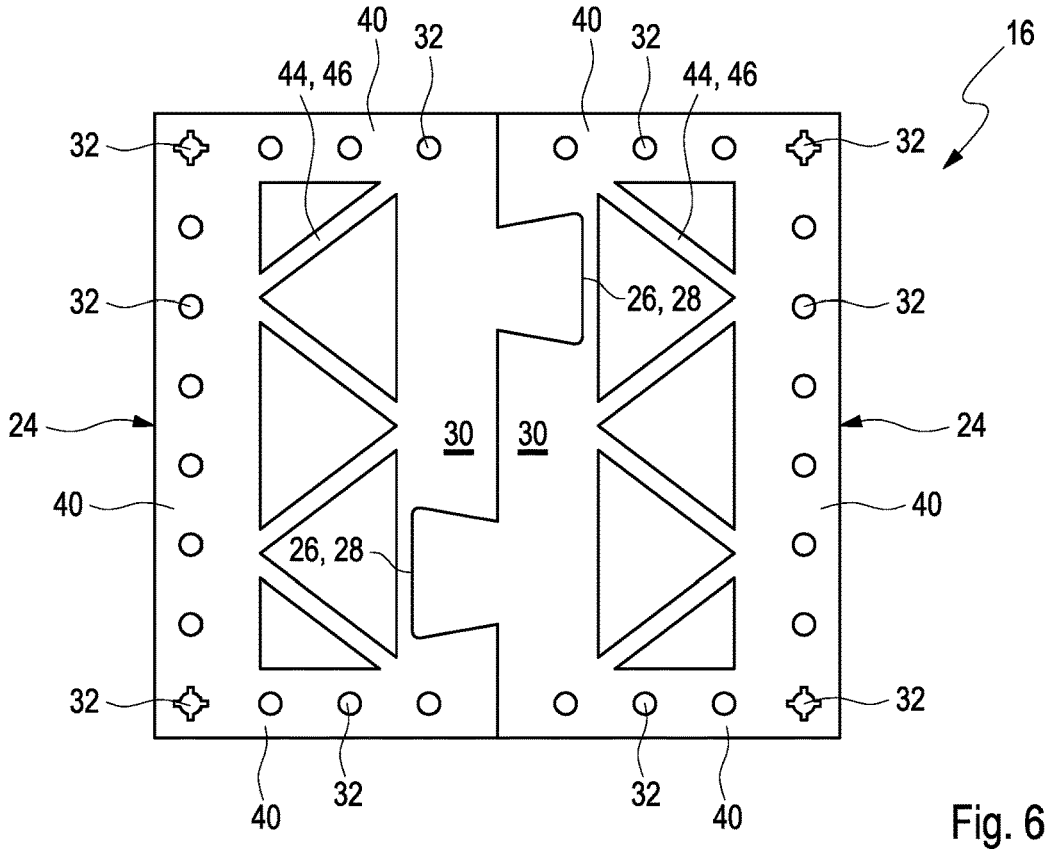
FIG. 6*a* shows a front view of a further embodiment of a seat base module.

FIG. 6*a* shows a seat base module 16 consisting of two seat base elements 24, pushed together, with framework structures 46, wherein the framework structures 46 are designed as spring elements 44. Each seat base element 24 comprises a framework structure 46 on a base side 30, which can exhibit a spring characteristic and enables a significant reduction in weight and saving in material. Good rear ventilation of the sitting surface is also achieved through this. Multiple recesses 32 are provided on the base side 30 along the base side edge region to accommodate foot elements 20, wherein the recesses 32 are formed along the edge region 40 of the seat base module 16. The two seat base elements 24 are connected together by means of a pair of dovetail guides 28, wherein the dovetail guides 28 are designed as connecting means 26.

Figure 6B:
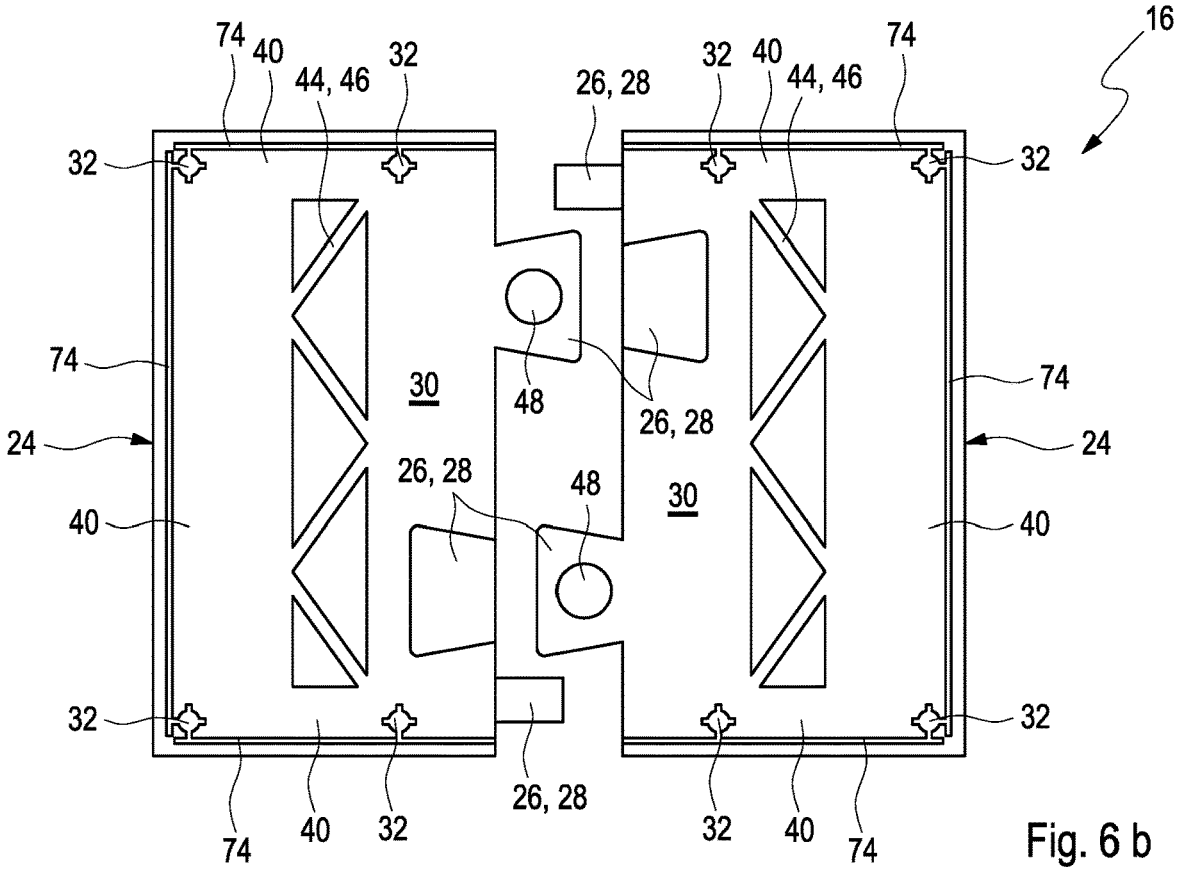
FIG. 6*b*—shows an exploded Illustration of a further embodiment of a seat base module.

In a further embodiment of a seat base module 16, two seat base elements 24 are connected together in FIG. 6*b* by two pairs of dovetail guides 28 that are designed as connecting means 26. Each seat base element 24 is provided on a base side 30 with a framework structure 46 designed as a spring element 44. A pot-shaped foot element 48 for floor-side support is pre-moulded in each dovetail joint. An insertion slot 74 for an push-in fastening of an upholstery element 18 is formed surrounding the edges on the base side 30 of the seat base module 16. Multiple recesses 32 to accommodate foot elements 20 are also provided on the base side 30 in an edge region 40 of the seat base module 16.

Figure 7:
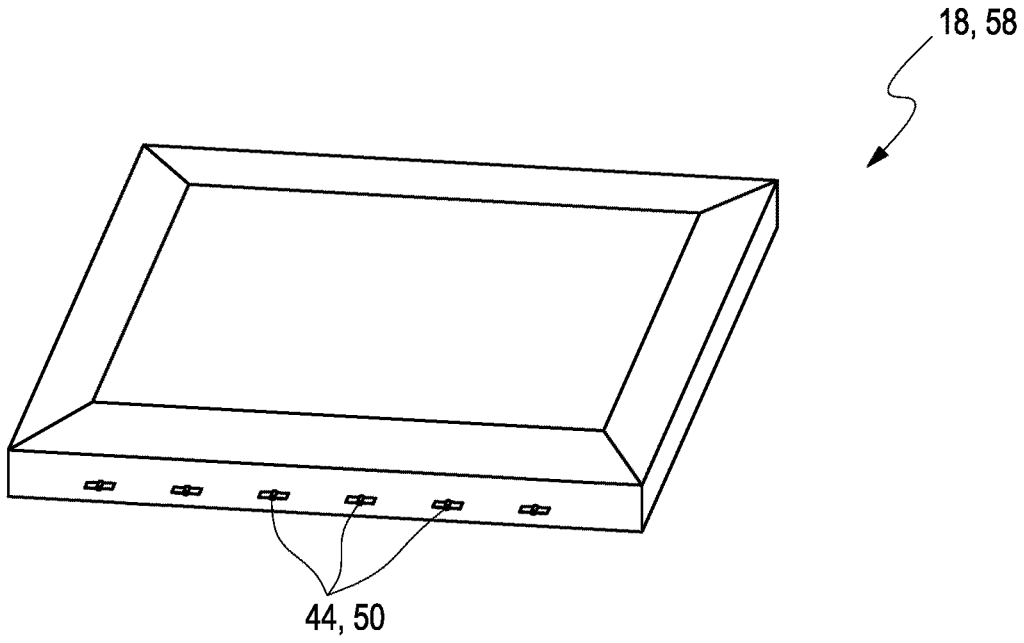
FIG. 7 shows a perspective illustration of a first embodiment of an upholstery element.

FIG. 7 shows an upholstery element 18 that is designed as a spring mat 58 that is capable of being placed on a seat base module 16. Multiple spring elements 44 are placed insertably in spring pockets in the spring mat 58, wherein the spring elements 44 are designed as spring strips 50.

Figure 8:
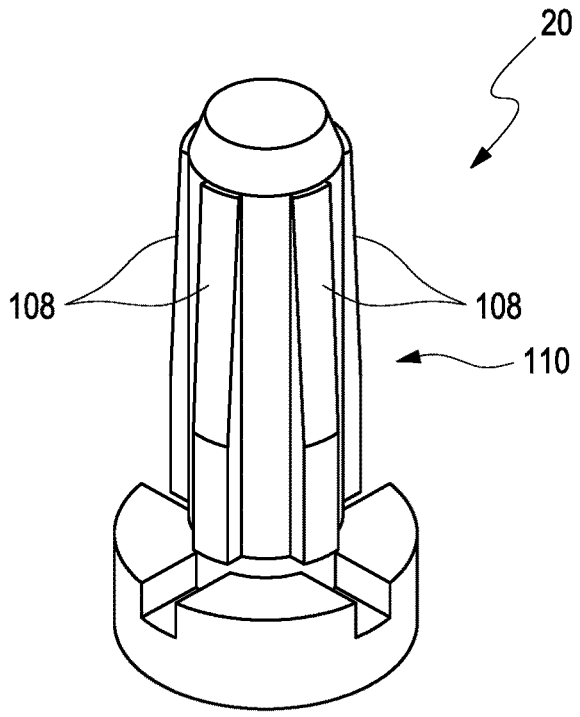
FIG. 8 shows a perspective illustration of a first embodiment of a foot element.

FIG. 8 shows a foot element 20, wherein multiple guide ribs 108 are provided in direction of the longitudinal axes in an push-in region 110. Because the guide ribs 108 press into recesses 32 formed on a base side 30 of a seat base module 16 when inserted into the bottom side 30 of the seat base module 16, which is made of a foamed and soft material, a form-fitting resistance to rotation and improved force-fitting insertion effect can be achieved.

Figure 9A:
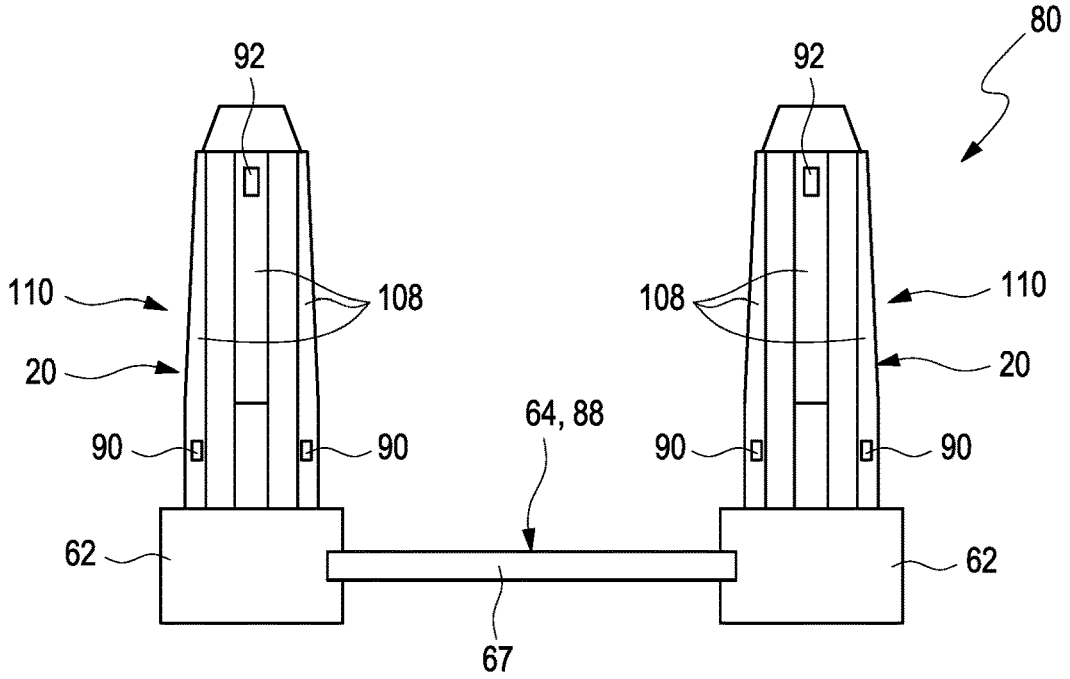
FIG. 9*a* shows a front view of a first embodiment of a foot element connection.
Figure 9B:
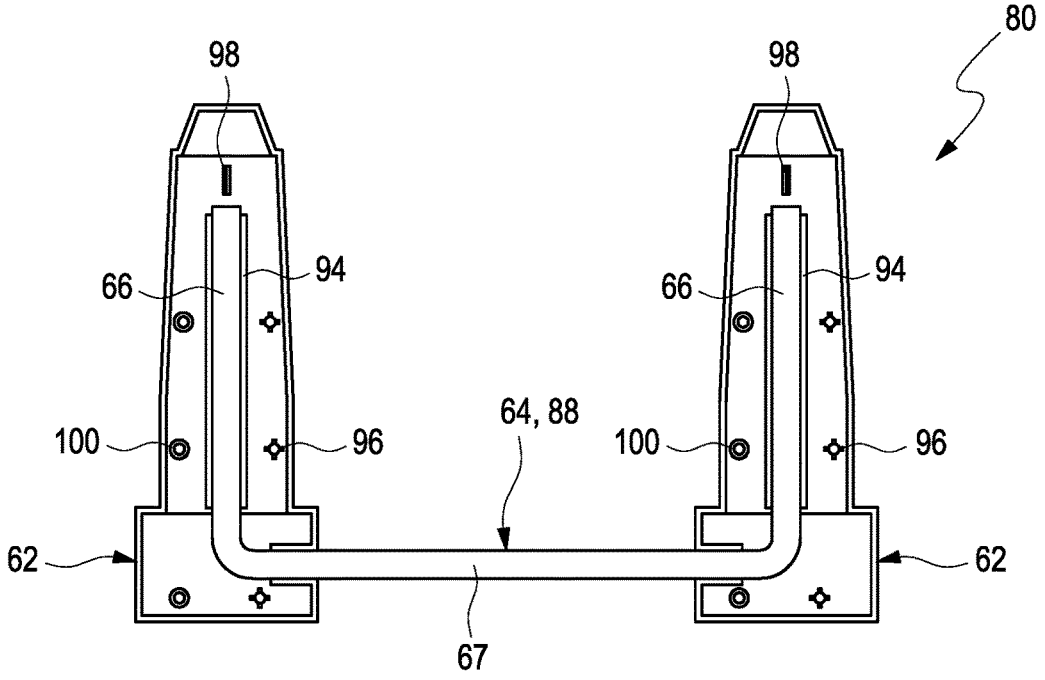
FIG. 9*b* shows a longitudinal section through the foot element connection illustrated in FIG. 9*a;*

FIGS. 9*a* and 9*b* show a foot element connection 80 consisting of the foot elements 20 illustrated in FIG. 8 and a bracket element 64. The two foot elements 20 are connected to one another by means of the connecting region 67 of the bracket element 64, wherein the bracket element 64 is designed as a metal bracket 88. The foot element 20 further consists of two shell parts 62 that are capable of being pushed together and latched, wherein each shell part 62 comprises an embedding receptacle 94 for an end region 66 of the bracket element 64. Two or more end regions 66 of bracket elements 64 may also be capable of being inserted in the embedding receptacle 94 in order, for example, to enable cross-corner connections; see FIG. 10. The shell parts 62 each comprise a push-in element 96, a push-in receptacle 100 and the latching element 98. A push-in connection 90 and a latching connection 92 may thereby be formed in the foot element 20, so that mechanical fixing by the push-in connection 90, and additional fastening by the latching connection 92, can be provided. The plurality of guide ribs 108 are furthermore provided in the push-in region 110 of each foot element 20.

Figure 10:
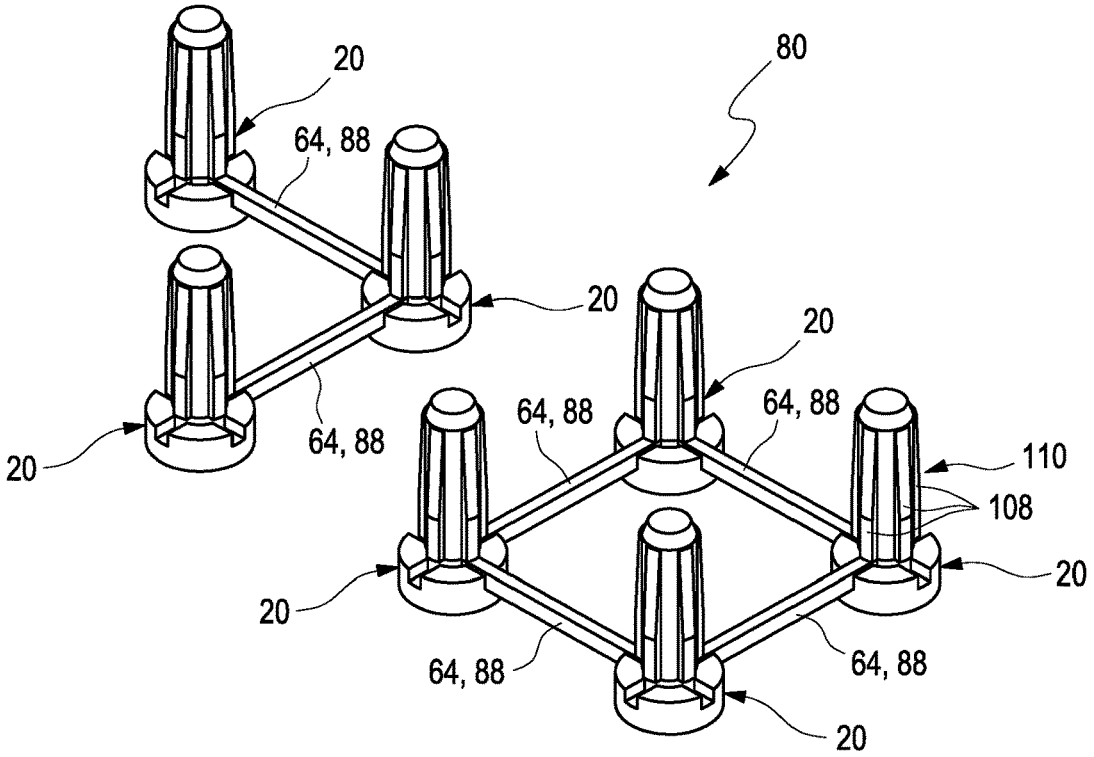
FIG. 10—shows a perspective illustration of various embodiments of a foot element combination.

Various foot element combinations are illustrated in FIG. 10, whereby foot elements 20 that are arranged adjacent to one another are connected by means of a bracket element 64, wherein multiple guide ribs 108 are provided in a push-in region 110 of each foot element 20. Two bracket elements 64 at a time may be accommodated at 90° to one another in one foot element 20 for over-corner connection.

Figure 11:
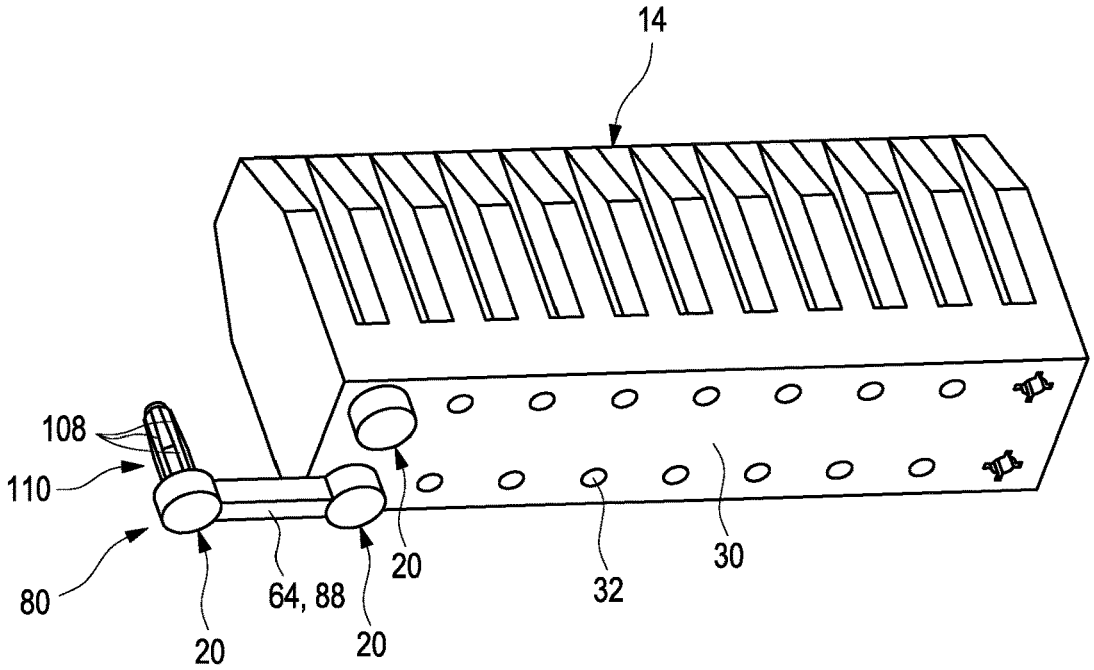
FIG. 11 shows a perspective illustration of a first embodiment of a backrest element with a foot element connection.

A backrest element 14 is shown in FIG. 11, wherein multiple recesses 32 to receive foot elements 20 are provided on a base side 30 of the backrest element 14. A single foot element 20 and a foot element connection 80 are inserted into the recesses 32, wherein multiple guide ribs 108 are formed in an push-in region 110 of the foot element 20. The two foot elements 20 are joined to one another by means of a bracket element 64 formed as a metal bracket 88 for foot element connection 80.

Figure 12A:
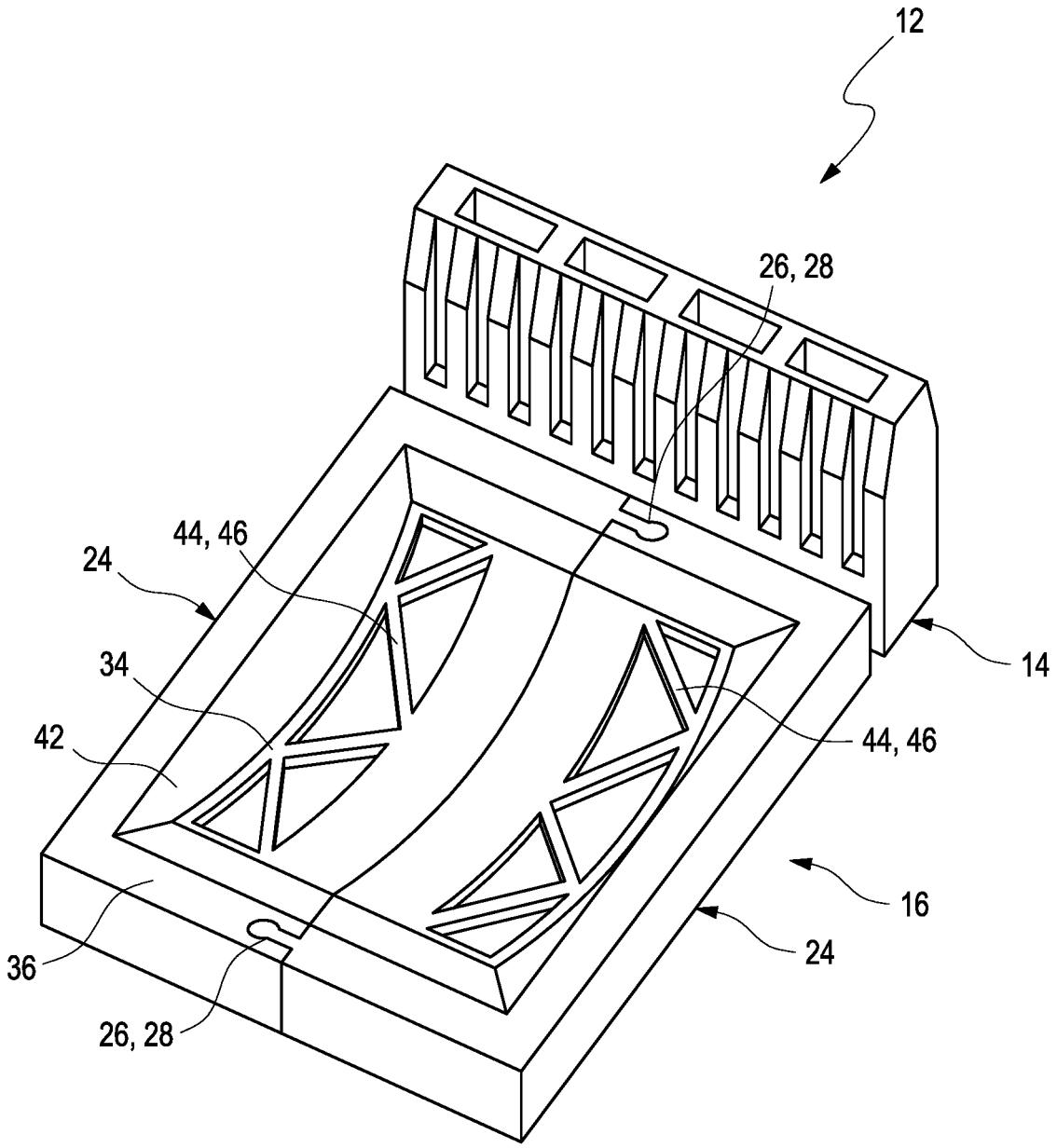
FIG. 12*a* shows a perspective illustration of a further embodiment of a furniture base module.
Figure 12B:
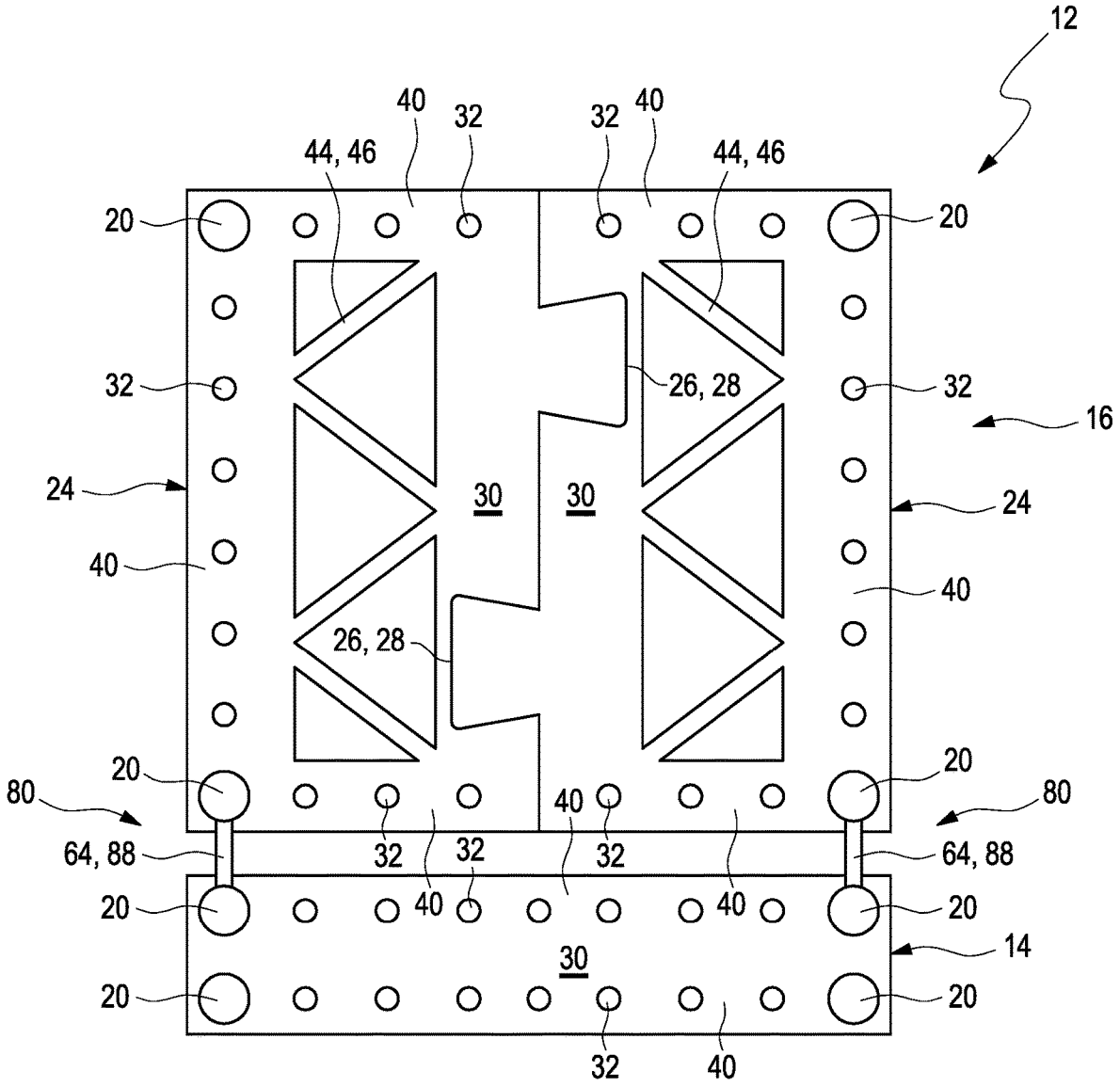
FIG. 12*b* shows a view from underneath of the furniture base module illustrated in FIG. 12*a;*

FIGS. 12*a* and 12*b* show a perspective view of a furniture base module 12 seen from the front and below, consisting of a backrest element 14 and a seat base module 16. The seat base module 16 comprises two seat base elements 24 that are connected together by means of a pair of dovetail guides 28, wherein the dovetail guides 28 are provided in a wall region 36 as connecting means 26. The seat base element 24 is provided on a base side 30 with a framework structure 46 designed as a spring element 44. The backrest element 14 is connected to the seat base module 16 by foot elements 20, wherein the foot elements 20 are inserted into recesses 32 that are located in an edge region 40 of the seat base module 16 and in an a region 40 of the backrest element 14, and are connected to one another by means of a bracket element 64. The bracket element 64 is designed as a metal bracket 88. A recess 42 to receive additional spring elements 44 is furthermore provided on a upper side of the seat base module 16.

Figure 13:
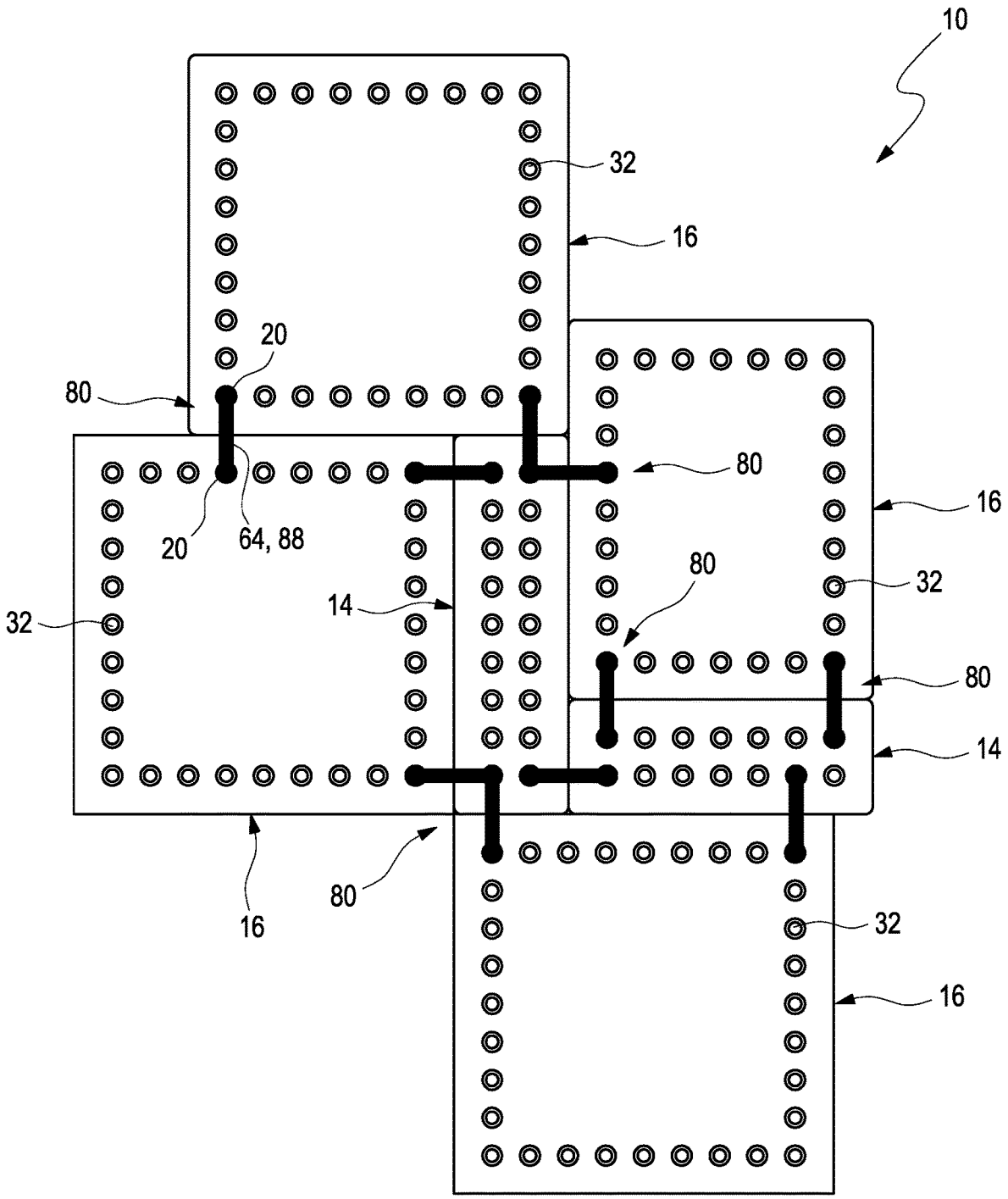
FIG. 13 shows a view from underneath of a modular furniture system according to a further embodiment.
Figure 14:
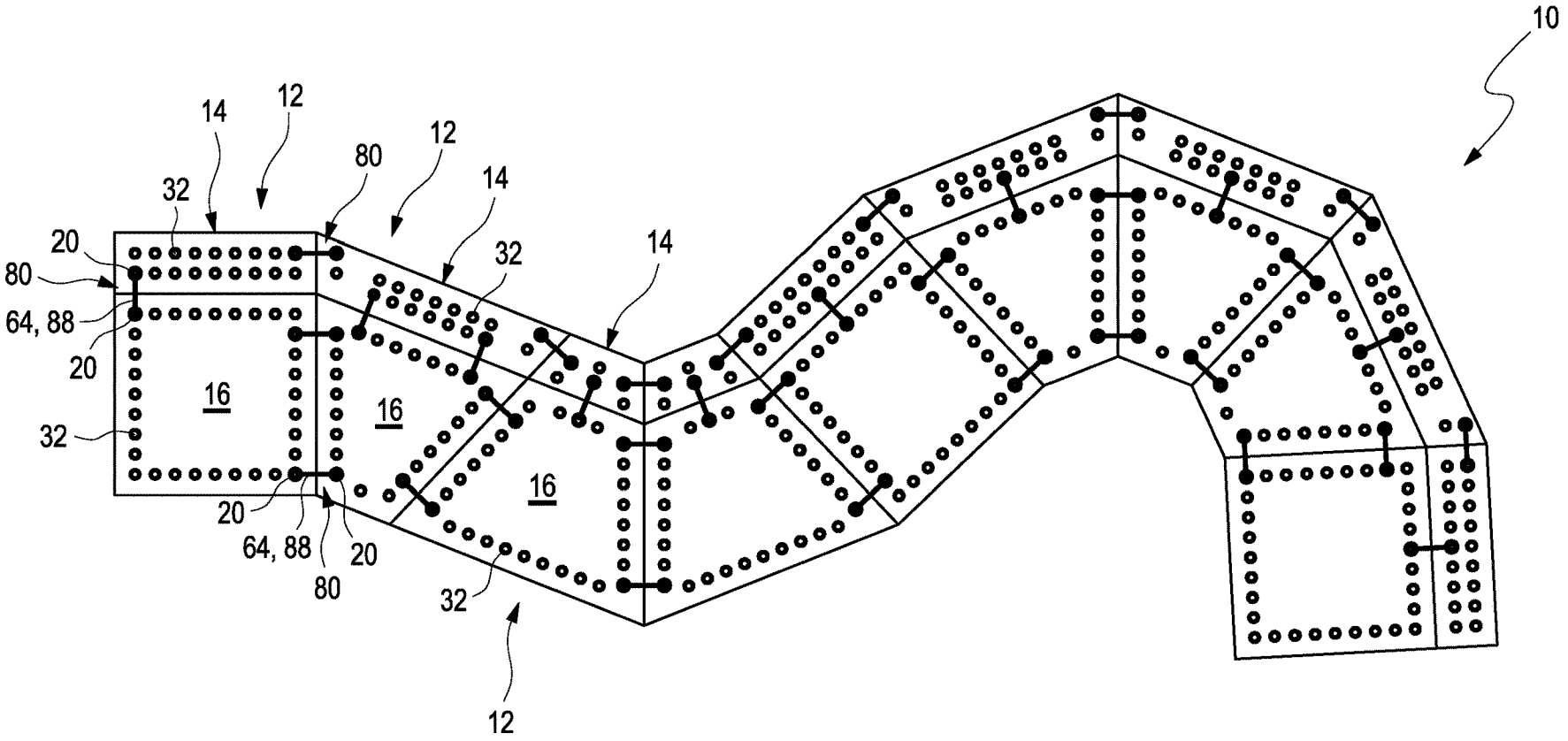
FIG. 14 shows a view from underneath of a modular furniture system according to a further embodiment.

Various embodiments of a modular furniture system 10 are illustrated in FIGS. 13 and 14. Seat base modules 16 and backrest elements 14 can be connected to one another individually in various ways in that foot elements 20 are inserted into corresponding recesses 32 and the neighbouring foot elements 20 are connected to one another by means of a bracket element 64. In FIG. 13 the seat base module 16 and the backrest element 14 are rectangular, and are trapezoidal in FIG. 14. A curved form of the module modular furniture system 10 with concave and convex seating areas is enabled by the trapezoidal backrest elements 14 and seat base modules 16.

Figure 15:
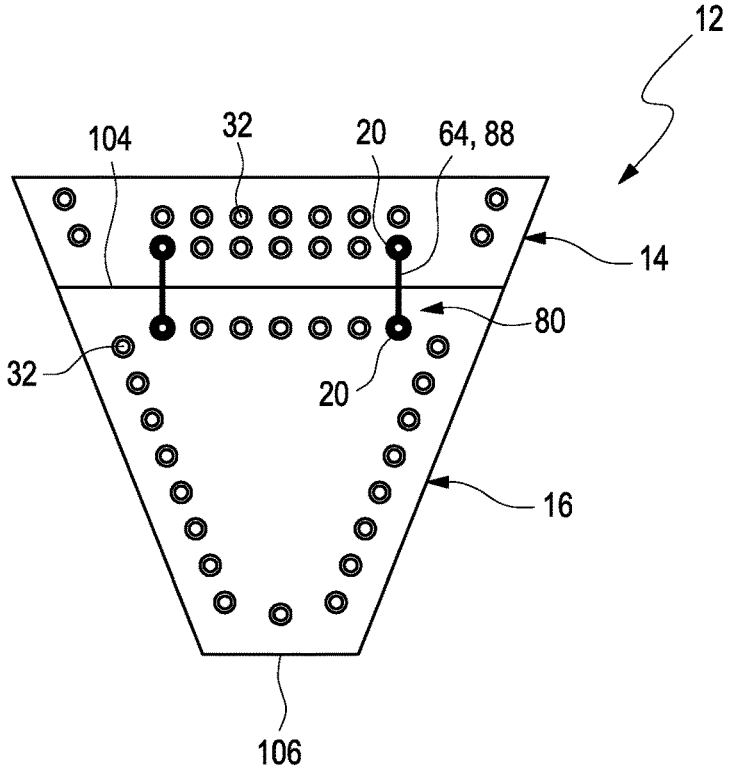
FIG. 15 shows a view from underneath of the furniture base module as illustrated in FIG. 14.
Figure 16:
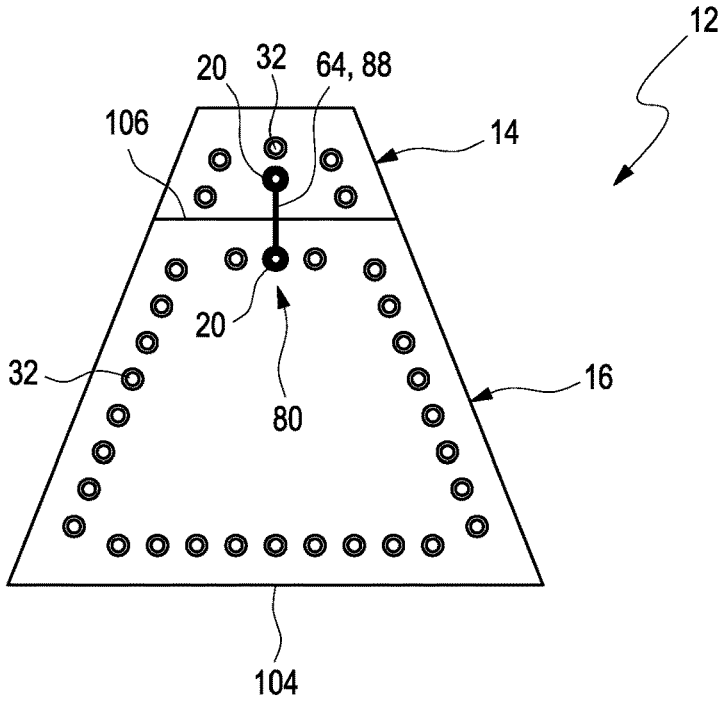
FIG. 16 shows a view from underneath of the furniture base module as illustrated in FIG. 14.

The furniture base modules 12 shown in FIG. 14 are illustrated in FIGS. 15 and 16, wherein in FIG. 15 the trapezoidal backrest element 14 is fastened to a long side 104 of the trapezoidal seat base module 16 by the foot elements 20.

In FIG. 16 the trapezoidal backrest element 14 is fixed to a short side 106 of the trapezoidal seat base module 16 by the foot elements 20. The foot elements 20 are inserted into the recesses 32 provided on a base side 30 of the backrest element 14 and of the seat base module 16, and are connected to one another by means of the bracket element 64.

Figure 17:
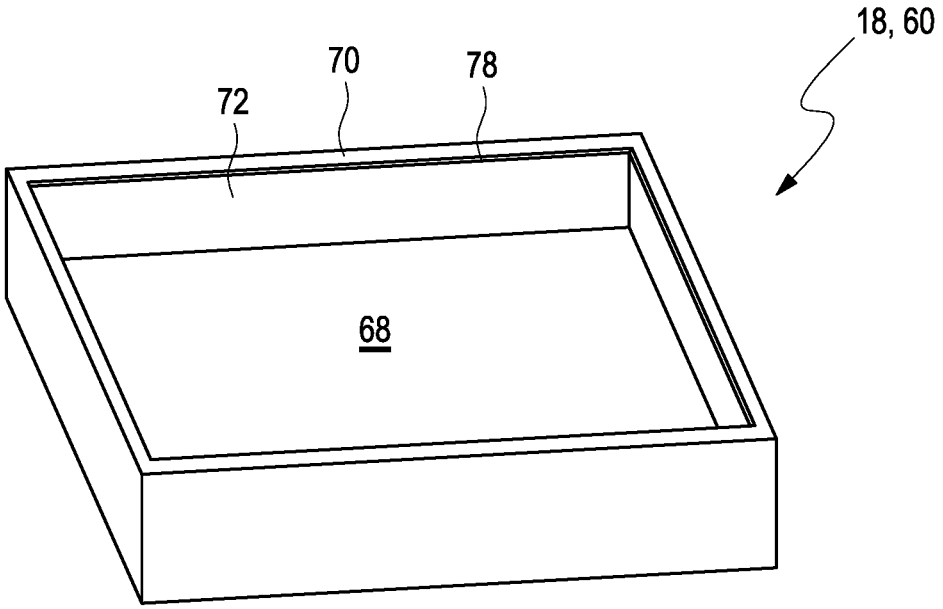
FIG. 17 shows a perspective illustration of a further embodiment of an upholstery element for the seat base module.
Figure 18:
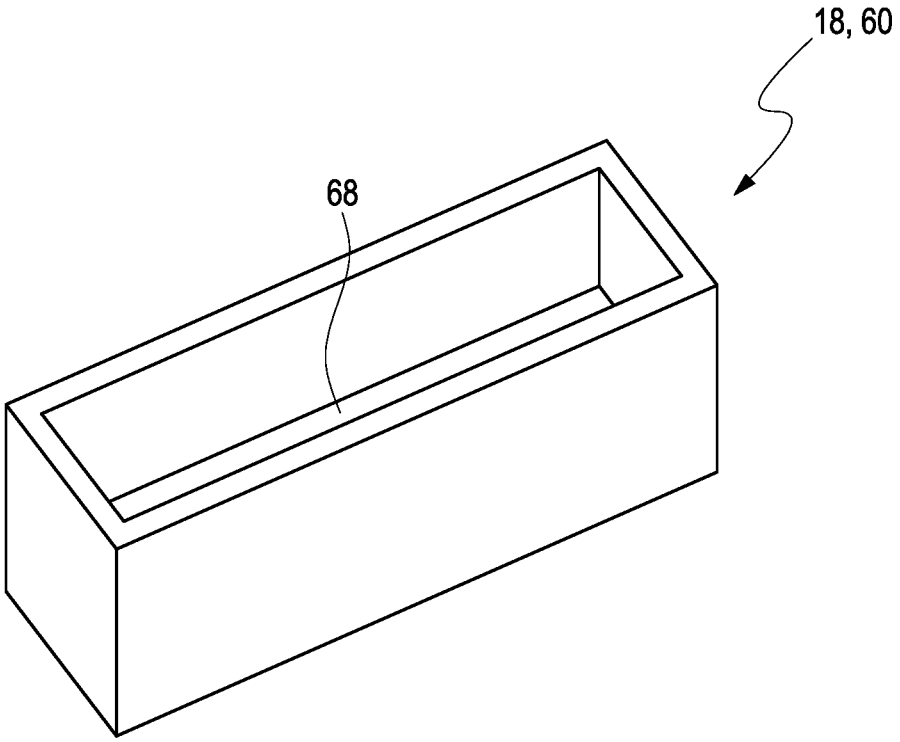
FIG. 18 shows a perspective illustration of a further embodiment of an upholstery element for the backrest element.

An upholstery element 18 for a seat base module 16 and an upholstery element 18 for a backrest element 14 are illustrated in FIGS. 17 and 18, wherein the upholstery element 18 is designed as a cushion cover 60. The upholstery element 18 can be provided with a padding 68 of, for example, rod-fibre filling with a thickness of about 5 cm. The upholstery element 18 designed for the seat base module 16 is provided along its lower opening 72 with a hook and loop tape 70 surrounding it along a side wall 78. In this way the upholstery element 18 can be fixed to the seat base module 16 in the manner of a hook and loop connection to a complementary hook and loop tape running around a peripheral surface on the floor-side.

Figure 19:
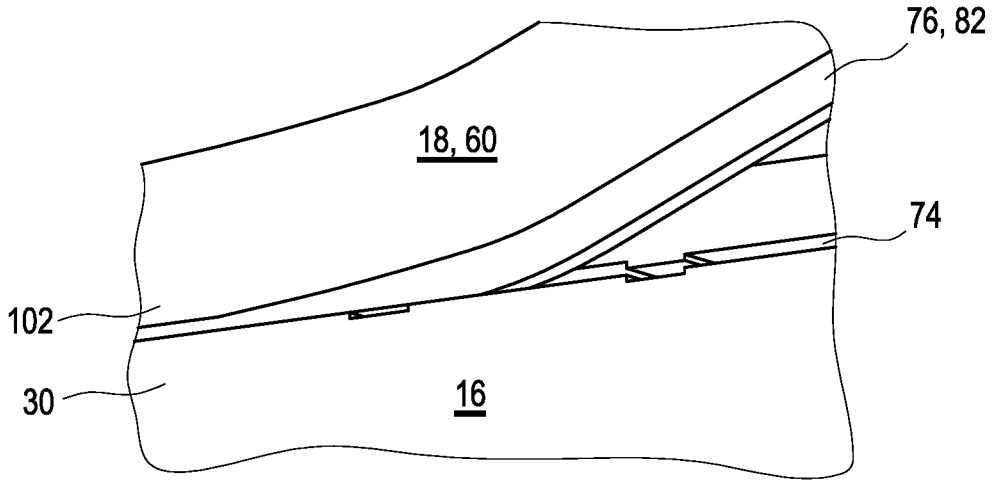
FIG. 19 shows a perspective illustration of a first embodiment of an end strip inserted into an insertion slot on a base side of a seat base module.

In FIG. 19 a hem region 102 of an upholstery element 18 is provided with an end strip 76 for closing an opening 72 of the upholstery element 18, wherein an insertion slot 74 is formed on a base side 30 of a seat base module 16. Because the end strip 76 is inserted into the insertion slot 74, the upholstery element 18 can be fastened to the seat base module 16. The end strip 76 is, furthermore, designed as a plastic strip 82.

Figure 20:
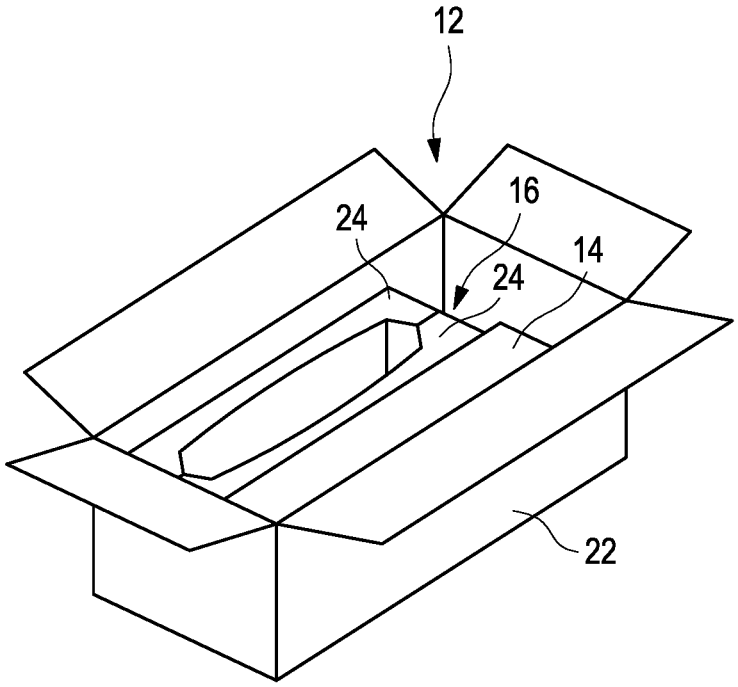
FIG. 20 shows a perspective illustration of a first embodiment of a packaging of a modular furniture system.

In FIG. 20, a seat base module 16 consisting of two seat base elements 24, a backrest element 14, spring elements 44, two upholstery element 18 and a plurality of foot elements 20 are stacked in a shipping carton 22 in a compact manner. A furniture base module 12 for one person can thereby be transported very easily and shipped economically. The furniture base module 12 is capable of being packed ready for assembly in the shipping carton 22 with low dimensions, in particular with dimensions of up to 120 cm×60 cm×60 cm, and with a reduced weight, in particular with a weight of less than 30 kg.

LIST OF REFERENCE SIGNS

10 Modular furniture system
12 Furniture base module
14 Backrest element
16 Seat base module
18 Upholstery element
20 Foot element
22 Shipping carton
24 Seat base element
26 Connecting means
28 Dovetail guide
30 Base side
32 Recess
34 Upper side
36 Wall region
38 Base region
40 Edge region
42 Recess
44 Spring element
46 Framework structure
48 Pot-shaped foot element
50 Spring strip
52 Core
54 Leaf spring envelope
56 Wing area
58 Spring mat
60 Cushion cover
62 Shell part
64 Bracket element
66 End region of the bracket element, insertion region
67 Connecting region of the bracket element
68 Padding
70 Hook and loop tape
72 Opening
74 Insertion slot
76 End strip
78 Side walls
80 Foot element connection
82 Plastic strip
84 Fastening means
86 Screw
88 Metal bracket
90 Push-in connection
92 Latching connection
94 Embedding receptacle
96 Push-in element
98 Latching element
100 Push-in receptacle
102 Hem region of the upholstery element
104 Long side
106 Short side
108 Guide rib
110 Push-in region

The invention claimed is:

1. A modular furniture system for a variety of purposes comprising:

at least one furniture base module consisting of a backrest element, a seat base module, two upholstery elements and a plurality of foot elements; wherein;

the seat base module consists of at least two seat base elements, wherein the seat base elements are preferably substantially identically designed and each of the at least two seat base elements include both a complimentary male connecting means and a female guide, such that the at least two seat base elements are capable of being joined to one another to form a seat base module by connecting the male connecting means of at least one seat base element to the female guide of another seat base element without tools; and the backrest element and the seat base module are capable of being connected and fastened by the foot elements without the use of tools, so that the furniture base module is capable of being packed ready for assembly in a shipping carton with low dimensions up to 120 cm×60 cm×60 cm, and with a reduced weight of less than 30 kg, wherein a combined length and girth of up to 360 cm can be maintained.

2. The modular furniture system according to claim 1, wherein the seat base element is capable of being plugged together and joined to form the seat base module in a functionally complementary manner by means of at least one pair, wherein the at least one pair includes at least one pair of dovetail guides designed as the connecting means.

3. The modular furniture system according to claim 2, wherein the at least one pair of dovetail guides is provided either in a wall region and/or in a base region of the seat base element.

4. The modular furniture system according to claim 2, wherein the at least one pair of dovetail guides comprises at least two pairs of the dovetail guides, the dovetail guides being formed in a wall region and/or in a base region of the seat base element.

5. The modular furniture system according to claim 2, wherein at least one pot-shaped foot element is pre-moulded in the dovetail guides to support the furniture base module on a floor side.

6. The modular furniture system according to claim 1, wherein at least one recess to accommodate the foot elements is provided on a base side of the seat base module and/or on a base side of the backrest element, wherein the recesses are preferably formed in an edge region of the seat base module and/or of the backrest element.

7. The modular furniture system according to claim 6, wherein at least one seat base element of the seat base module comprises a framework structure, preferably with a spring characteristic, wherein the framework structure is preferably formed on a floor side of the seat base element.

8. The modular furniture system according to claim 6, wherein an insertion slot is formed on at least one edge of a floor side of the seat base module and/or on a floor side of the backrest element at least in sections for a plug-in fastening of each upholstery element.

9. The modular furniture system according to claim 8, wherein at least one hem region of each upholstery element is provided with an end strip for closing off an opening of each upholstery element, wherein the end strip is capable of being inserted into the insertion slot so that each upholstery element may be fastened to the seat base module and/or to the backrest element.

10. The modular furniture system according to claim 1, wherein the foot elements that are arranged adjacent to one another and are capable of being connected to one another by means of at least one bracket element.

11. The modular furniture system according to claim 10, wherein each foot element consists of at least two shell parts that are capable of being plugged together and latched, wherein each shell part comprises an embedding receptacle for an end region of the bracket element.

12. The modular furniture system according to claim 1, wherein at least one recess is formed on an upper side of the seat base element along a wall region to accommodate spring elements for each upholstery element arranged on the seat base module.

13. The modular furniture system according to claim 12, wherein at least one of the spring elements is designed as a spring strip, wherein the spring strip comprises a leaf spring envelope with at least one wing area and at least one rod-shaped core arranged in the leaf spring envelope with a spring characteristic that depends on the material.

14. The modular furniture system according to claim 13, wherein each upholstery element is designed as a spring mat that is capable of being fastened to the seat base module and/or to the backrest element.

15. The modular furniture system according to claim 14, wherein the spring elements or the spring strips are inserted into the spring mat.

16. The modular furniture system according to claim 13, wherein the core and/or the leaf spring envelope with the at least one wing area is designed to be exchangeable with different materials.

17. The modular furniture system according to claim 1, wherein each upholstery element is designed in the form of a cushion cover with a lower opening, so that each upholstery element is capable of being stretched, without using tools, on the seat base module and/or on the backrest element.

18. The modular furniture system according to claim 17, wherein along the lower opening of each upholstery element or each cushion cover an at least partially surrounding hook and loop tape is provided on side walls of the opening for fixing each upholstery element or each cushion cover to the seat base module and/or to the backrest element, wherein a complementary hook and loop tape is provided running around a peripheral surface on a base side of the seat base module and/or of the backrest element.

19. The modular furniture system according to claim 1, wherein the seat base module and/or the backrest element are of trapezoidal design, wherein the backrest element is capable of being fastened by the foot elements at least to a long side or to a short side of the seat base module.

* * * * *